US006967589B1

(12) United States Patent
Peters

(10) Patent No.: US 6,967,589 B1
(45) Date of Patent: Nov. 22, 2005

(54) GAS/OIL WELL MONITORING SYSTEM

(75) Inventor: George W. Peters, Newport Beach, CA (US)

(73) Assignee: OleumTech Corporation, Irvine, CA (US)

( * ) Notice: Subject to any disclaimer, the term of this patent is extended or adjusted under 35 U.S.C. 154(b) by 631 days.

(21) Appl. No.: 09/929,473

(22) Filed: Aug. 13, 2001

Related U.S. Application Data

(60) Provisional application No. 60/224,711, filed on Aug. 11, 2000.

(51) Int. Cl.[7] ..... G01V 3/00

(52) U.S. Cl. ..... 340/854.6; 340/853.2; 361/752; 166/250.15

(58) Field of Search ..... 340/853.2, 853.3, 340/854.6, 853.7; 102/214; 361/752; 166/250.15

(56) References Cited

U.S. PATENT DOCUMENTS 5,438,329 A * 8/1995 Gastouniotis et al. .. 340/870.02
5,717,718 A * 2/1998 Rowsell et al. ..... 375/260
5,963,650 A * 10/1999 Simionescu et al. ..... 705/63
6,062,095 A * 5/2000 Mulrooney et al. ..... 73/866.5
6,169,488 B1 * 1/2001 Ketler ..... 340/632
6,305,471 B1 * 10/2001 Milloy ..... 166/250.15
6,356,205 B1 * 3/2002 Salvo et al. ..... 340/853.3
6,369,715 B2 * 4/2002 Bennett et al. ..... 340/618
6,574,652 B2 * 6/2003 Burkhard ..... 718/1
6,693,553 B1 * 2/2004 Ciglenec et al. ..... 340/853.1
6,795,319 B2 * 9/2004 Preston et al. ..... 361/752

* cited by examiner

*Primary Examiner*—Albert K. Wong
(74) *Attorney, Agent, or Firm*—Morland C. Fischer

(57) ABSTRACT

A system for monitoring a gas/oil well is provided with a monitoring unit, a relay unit and a host interface. A monitoring unit collects data regarding the status of the gas/oil well and wirelessly transmits that data to a relay unit. The relay unit, in turn, connects to a host interface using cellular communications and transmits the data. The monitoring unit can transmit information on demand or after an alarm condition is sensed. In either case, the monitoring unit is normally in a sleep mode. The relay unit can request information from the monitoring unit or respond to a wake up transmission sent to it from either the host interface or monitoring unit. The host interface receives data from the relay unit and then informs an end user of that data.

11 Claims, 11 Drawing Sheets

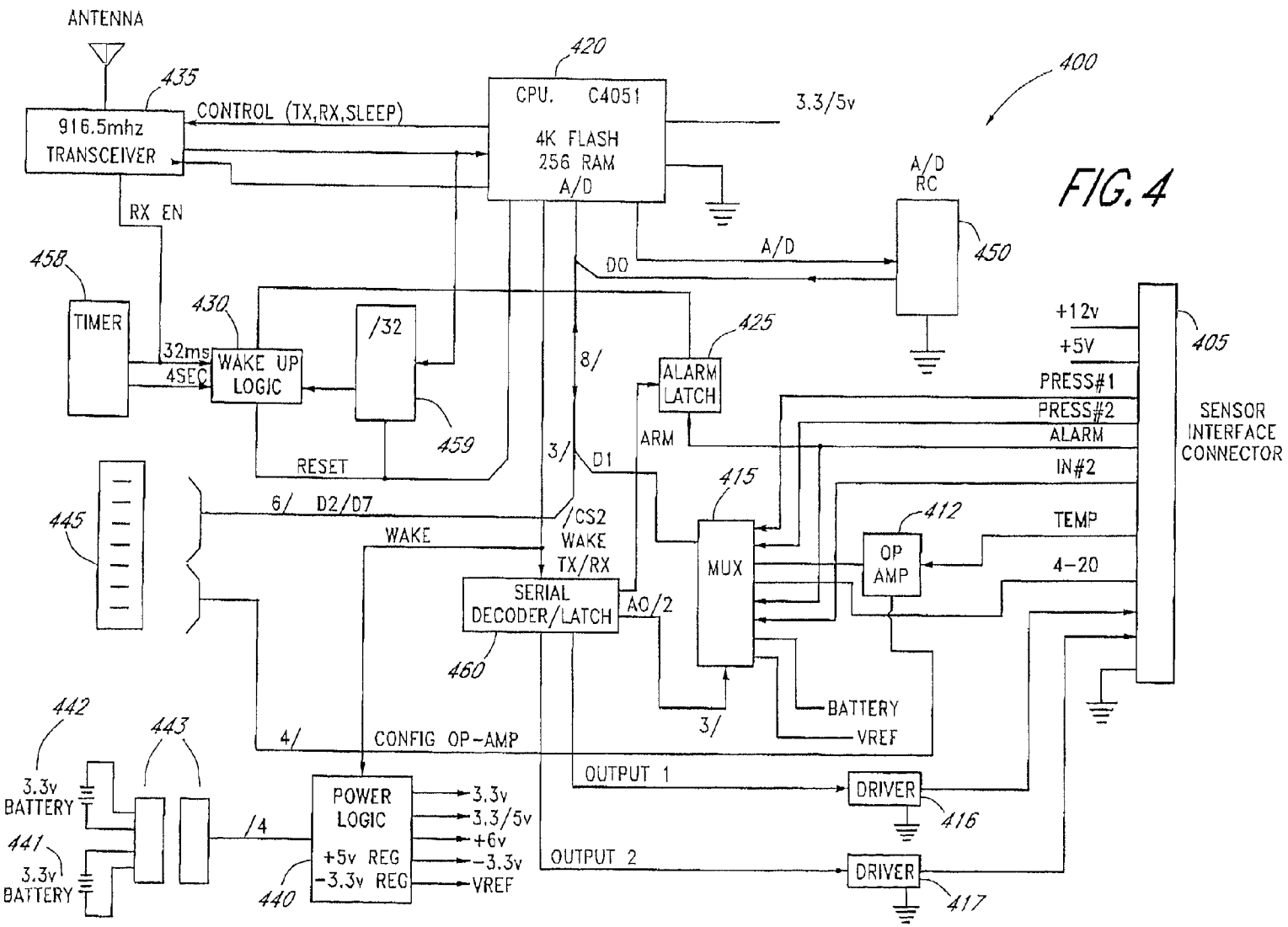
400
FIG. 4
405
SENSOR INTERFACE CONNECTOR
+12v
+5V
PRESS#1
PRESS#2
ALARM
IN#2
TEMP
4-20
450
A/D RC
412
OP AMP
416
DRIVER
417
DRIVER
BATTERY
VREF
3.3/5v
A/D
425
ALARM LATCH
415
MUX
3/
ARM
420
CPU. C4051
4K FLASH
256 RAM
A/D
D0
8/
D1
3/
/CS2
WAKE
TX/RX
A0/2
SERIAL DECODER/LATCH
460
OUTPUT 1
OUTPUT 2
CONFIG OP-AMP
3.3v
3.3/5v
+6v
-3.3v
VREF
POWER LOGIC
+5v REG
-3.3v REG
440
459
/32
WAKE
RESET
D2/D7
6/
4/
/4
CONTROL (TX,RX,SLEEP)
430
WAKE UP LOGIC
32ms
4SEC
435
916.5mhz TRANSCEIVER
RX EN
ANTENNA
458
TIMER
445
443
442
3.3v BATTERY
441
3.3v BATTERY Date: _____ Time: _____ Pho.# _____

Field _____ State _____ Battery Percentage _____

I.D.# _____ Name _____

Tubing Pressure _____ Casing Pressure _____

| Water Tanks | | Oil Tanks | |
|---|---|---|---|
| Level | Barrels | Level | Barrels |
| 1._____ | _____ | 1._____ | _____ |
| 2._____ | _____ | 2._____ | _____ |

Gas Rate

| Gas Rate | Static | Differential | Orifice |
|---|---|---|---|
| _____ | _____ | _____ | _____ |

| Spot Rate | 24 hour Rate | Accumulative Rate |
|---|---|---|
| _____ | _____ | _____ |

---

I.D.# _____ Name _____

Tubing Pressure _____ Casing Pressure _____

| Water Tanks | | Oil Tanks | |
|---|---|---|---|
| Level | Barrels | Level | Barrels |
| 1._____ | _____ | 1._____ | _____ |
| 2._____ | _____ | 2._____ | _____ |

Gas Rate

| Gas Rate | Static | Differential | Orifice |
|---|---|---|---|
| _____ | _____ | _____ | _____ |

| Spot Rate | 24 hour Rate | Accumulative Rate |
|---|---|---|
| _____ | _____ | _____ |

FIG. 7

```
Relay: COPLIS WELL#5
            ID: 3184554912
            Date: 07/25/01      Time: 23:04:57
---------------
Monitor: Oil Tanks
                                Battery 3.76    100%
                                VRef OK
            Sensor: Oil #1      Oil Tank 0% .00 Barrels
            Sensor: Oil #2      Oil Tank 4% 8.07 Barrels
            Sensor: Oil #3      Oil Tank 100% 205.80 Barrels
            Sensor: Oil #4      Oil Tank 100% 205.80 Barrels
            Sensor: Oil #5      Oil Tank 100% 205.80 Barrels
            Sensor: Oil #6      Oil Tank 100% 205.80 Barrels
---------------
Monitor: Water Tanks
                                Battery 3.78 100%
                                VRef OK
            Sensor: Water       Water Tank 0% .00 Barrels
---------------
Monitor: Pressure
                                Battery 3.71 100%
                                VRef OK
            Sensor: Gas         Gas 17% 17 PSI
            Sensor: Oil         Oil 8% 8 PSI
```

FIG. 8

GAS/OIL WELL MONITORING SYSTEM

REFERENCE TO RELATED APPLICATION

The present application claims priority benefit under 35 U.S.C. §119(e) from U.S. Provisional Application No. 60/224,711, filed 11 Aug. 2000, entitled "REMOTE MONITORING OF GAS OR OIL WELLS."

BACKGROUND OF THE INVENTION

1. Field of the Invention

This invention relates to delivery of data to a user system. More specifically, this invention relates to delivery of gas/oil well status information to a user system.

2. Description of the Related Art

In the gas and oil industry, typically personnel called "gaugers" are employed to measure the volume and quality of the oil produced at a gas/oil well site, among other measurements. These "gaugers" usually visit a gas/oil well site once a day and write down measurements taken from mechanical gauges. The gas/oil well sites are typically located in remote areas, which are difficult to visit. The "gauger" has to drive a special truck, designed to insure safety, to these remote areas to record the measurements in order to report them to the owner of the gas/oil well.

The measurements, however, can be inaccurate due to mechanical error (e.g., wear, sticking of parts, etc.), human error (e.g., misreadings) and other conditions (e.g., bad weather). Exacerbating these problems, the "gauges" have to be calibrated often and replaced periodically due to malfunction or wear. Moreover, there may be a significant delay in getting the information from the "gaugers" to the intended audience. This delay can be grave if a malfunction or alarm triggering event occurs at the gas/oil well. Thus, there is no process or mechanism by which alarm events—such as an over-spill in an oil tank—can be quickly determined. If a "gauger" is not around when a tank is overspilling, for example, the tank will continue to over-spill until the next time the "gauger" happens to visit. Likewise, if there happens to be bad weather, such as a tropical storm, "gaugers" may likely not perform their gauging duties, thereby preventing the collection of much needed information. Similarly, there is no process by which the end recipient of the information can verify whether or not the "gauger" actually took the measurement or the method which was used. By way of example, a "gauger" could be inebriated or drugged while recording the measurement, and thus later report erroneous information.

In addition to these problems, the gas/oil well site itself is an extraordinarily dangerous place. Most of the drilling and pumping occurs at very high pressures. Moreover, the natural gas and oil present in the oil well area are extremely dangerous fire and explosion hazards. Finally, since many of these gas/oil well sites are located in remote areas, often time venomous snakes and vicious alligators pose another safety hazard a "gauger" must confront.

Thus "gaugers" place themselves in much danger with every visit to the gas/oil well site. Furthermore, the information that the "gaugers" gather may lack accuracy and precision. Also, any information gathered may only reach its intended audience after hours if not days of delay.

Therefore, there is a need for a monitoring system of an oil well for providing highly accurate information using an inexpensive, expedient method that avoids safety hazards.

SUMMARY OF THE INVENTION

Based on the foregoing, a need exists for a highly accurate system that monitors features of a gas/oil well site and avoids safety hazards. According to an embodiment, a system for monitoring a gas/oil well is provided. A monitoring unit at a well head includes a wireless transmitter consuming power at a safe level for avoiding an explosion risk. A relay unit includes a wireless receiver that communicates with the monitoring unit transmitter and further includes a telephone communication link. A host interface communicates with the relay unit through the telephone communication link.

According to another embodiment, a system for monitoring a gas/oil well is provided. A monitoring unit located within a danger zone includes a wireless monitor transceiver and sensor processing electronics which are housed in a gas tight box. In this embodiment, a relay unit includes a wireless relay transceiver that communicates with the monitor transceiver.

According to another embodiment, the monitoring unit at the gas/oil well is housed in a substantially gas tight, explosion proof housing. In this embodiment, the monitoring unit's low power wireless communications apparatus is located outside the monitoring unit housing, but is in electrical communication with the monitoring unit's other circuitry inside the monitoring unit housing.

In one embodiment, the monitored feature is pressure at the gas/oil well head. In other embodiments, the monitored feature is temperature, flow or pressure at the bottom of a tank.

According to another embodiment, an apparatus for monitoring a gas/oil well is provided. A gas tight housing contains sensor processing electronics. In this embodiment, an RF transceiver is located outside the gas tight housing and is in electrical communication with the sensor processing electronics inside the gas tight housing.

According to yet another embodiment, the monitoring unit and the relay unit are normally in a sleep mode, with only minimal circuitry active. Advantageously, the use of a sleep mode allows the monitoring unit and relay unit to conserve power allowing their batteries to last longer.

According to another aspect of the invention, a method for monitoring a feature at the gas/oil well site is provided. A monitoring unit may awake from its sleeping mode after sensing an alarm feature and transmit that alarm feature to the relay unit. The monitoring unit first wakes up the relay unit and then transmits the alarm feature. Next, the relay unit transmits the alarm feature to the host interface.

According to another aspect of the invention, a method for monitoring a gas/oil well is provided. In this embodiment, a condition of the gas/oil well at the gas/oil well site is sensed. Then, a CPU in the monitoring unit is awaken. Next, the sensed condition from the gas/oil well site is transmitted to a relay unit over a wireless link.

According to another aspect of the invention, a method of communicating to and from an explosive environment is provided. A first transceiver is situated in an explosive environment and operates at a power level which is below the level defined as dangerous within the explosive environment. A second transceiver is situated proximate to but outside of the explosive environment and operates at a power level which is above the level defined as dangerous within said explosive environment. Next, communications occur with the first transceiver through said second transceiver from a location outside of said explosive environment and not proximate to said explosive environment.

According to another aspect of the invention, apparatus for communicating to and from an explosive environment is provided. A first transceiver in the explosive environment operates at a power level which is below the level defined as dangerous within the explosive environment. A second transceiver is proximate to but outside of the explosive environment and operates at a power level which is above the level defined as dangerous within the explosive environment. A third transceiver is outside of the explosive environment and is not proximate to the explosive environment and is configured to communicate with said first transceiver through the second transceiver.

According to another aspect of the invention, a method of communicating to and from an explosive environment is provided. A first transceiver is situated in the explosive environment and has a short, first range and operates at a low, first power level. A second transceiver, situated outside of the explosive environment but within the short, first range, and has a longer, second range and additionally operates at a higher, second power level. A third transceiver is situated outside the explosive environment, outside the short, first range, but within the second, longer range. The first and third transceivers communicate through said second transceiver.

According to another aspect of the invention, an apparatus for communicating to and from an explosive environment is provided. A first transceiver positioned in the explosive environment has a short, first range and operates at a low, first power level. A second transceiver positioned outside the explosive environment but within said short, first range, has a longer, second range and operates at a higher, second power level. A third transceiver, positioned outside the explosive environment and outside the short, first range, but within the second, longer range, is configured to communicate with the first transceiver through the second transceiver.

BRIEF DESCRIPTION OF THE DRAWINGS

FIG. 4 illustrates a block diagram of the monitoring unit, according to aspects of an embodiment of the invention;

FIG. 7 illustrates a screen shot of a user report; and

FIG. 8 illustrates a screen shot of a user report; and

DETAILED DESCRIPTION OF THE PREFERRED EMBODIMENT

The following description and examples illustrate preferred embodiments of the present invention in detail. Those of skill in the art will recognize that there are numerous variations and modifications of this invention that are encompassed within its scope. Accordingly, the description of preferred embodiments should not be deemed to limit the scope of the present invention. Reference numbers are used to indicate items in the included figures. Reference numbers are reused between figures to indicate the same item.

OVERVIEW

Figure 1:
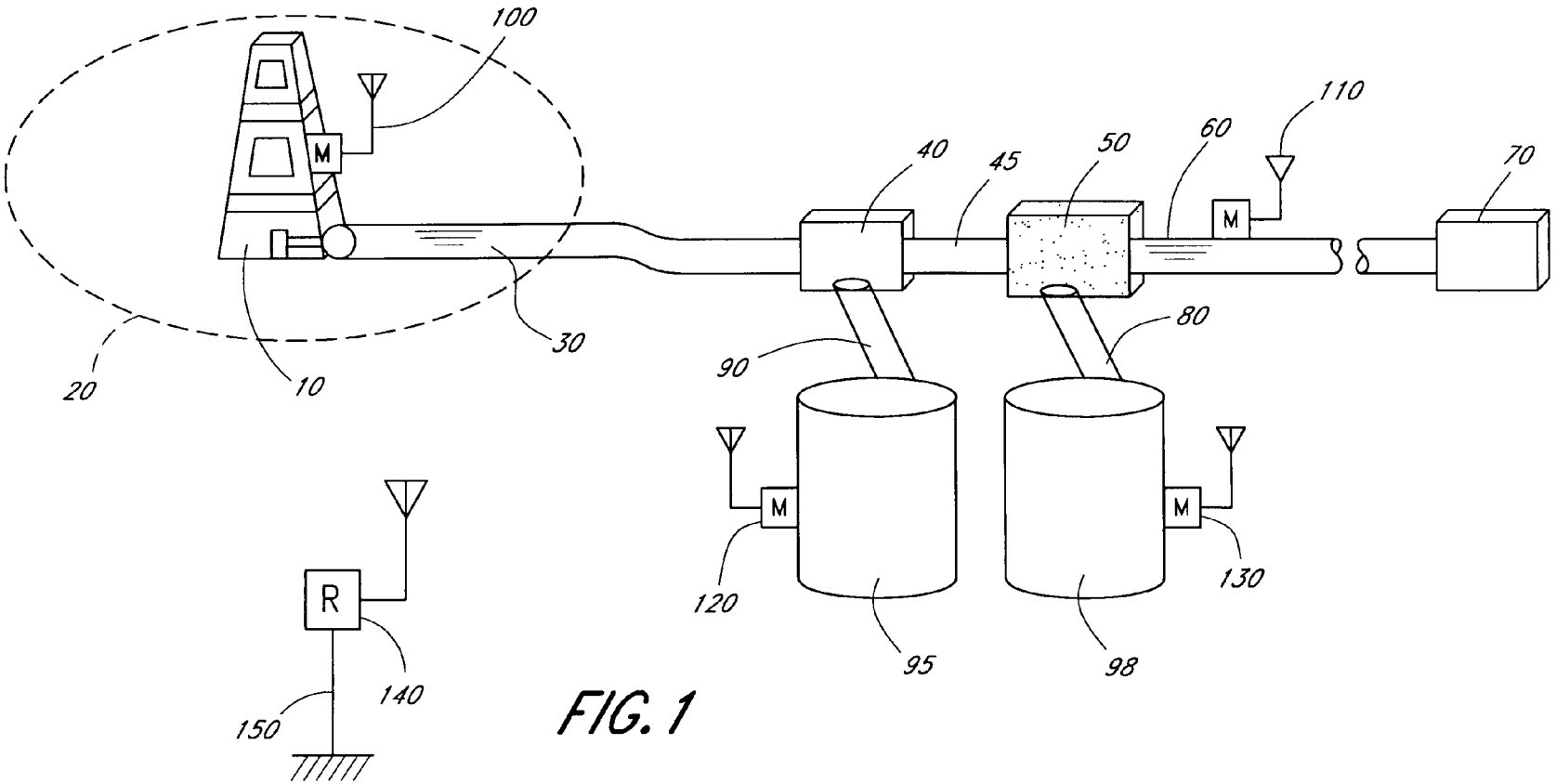
FIG. 1 illustrates a block diagram of a gas/oil well site, according to aspects of an embodiment of the invention.

As illustrated in FIG. 1, a preferred embodiment of the present invention may comprise a system have several components. Viewed very broadly, the component landscape comprises a gas/oil well 10, an oil tank 95, a water tank 98, a compressor 70, monitoring units 100, 110, 120, 130, and a relay unit 140. A first pipeline 30 connects the gas/oil well 10 to the first separator 40; a second pipeline 45 connects the first separator 40 to the second separator 50; a third pipeline 60 connects the second separator to the compressor 70. A fourth pipeline 90 connects the first separator 40 to the oil tank 95, whereas a fifth pipeline 80 connects the second separator to water tank 98.

A "danger zone" 20 is indicated by the area defined by the broken line. The "danger zone" 20 is typically an area of 150 feet radius around the gas/oil well 10. This distance is subject to variations due to the particular well and due to the legislation or standards in the jurisdiction where the well is located. In this "danger zone" 20, high levels of gas and oil fumes and potential gas and oil themselves may be present. Additionally, the machinery (e.g., compressors) in the "danger zone" 20 operates at high speeds and pressures. The "danger zone" 20 is a Class 1 hazardous area. As such, the "danger zone" 20 represents the area in which extreme safety measures must be followed. Sparks, electrical energy, extreme heat or the like could cause the oil and gas present in this "danger zone" 20 to ignite or explode. Thus, all equipment must be properly grounded in this area to avoid a spark. Additionally, any electrical equipment in or near this area should consume and transmit only small amounts of energy. The areas just outside of the "danger zone" 20 also represent a safety hazard, but to a lesser degree.

More specifically, a gas/oil well 10, located inside the "danger zone" 20, delivers three main products from the ground through its well head or "tree" (not shown): natural gas, oil and water. The water may be mixed with other products such as acids. The piping (not shown) of the gas/oil well that goes into the ground is comprised of two co-centric pipes. The inner pipe, called the "tubing," carries the natural gas, oil and water to the surface. The outer pipe, called the "casing," surrounds the inner pipe. The space between the inner and outer pipe, however, is empty. The outer pipe or casing is used as a safety shield, since the inner tubing can rupture due to high pressure.

There may be more than one gas/oil well at a site. As such, the number of wells may vary with each site and may be as high as eight per site. Regardless of the number of gas/oil wells at a site, each gas/oil well at a site processes its natural gas products into a single pipe line to be collected, preferably, through a compressor 70 and stored remotely. Similarly, each gas/oil well processes the oil and water products into oil and water tanks, respectively, located locally on site but typically outside the "danger zone" 20. The collected water and oil will be trucked away when the tanks are full.

Although there may be various numbers of gas/oil wells, pipelines and tanks, and a variety of interconnections, the following description refers to the embodiment of FIG. 1, where only one gas/oil well exists at a site. The example in FIG. 1, and all other examples, are not intended, however, to limit the breath or scope of the invention.

As shown in FIG. 1, gas/oil well 10 directs natural gas, oil and water through first pipeline 30 toward the first separator 40. The first separator 40 functions to separate the oil from the mixture of natural gas, oil and water present in first pipeline 30. Thus, the first separator 40 directs oil to oil tank 95 via fourth pipeline 90, while passing the remaining water and natural gas to the second separator 50 via second pipeline 45. Next, the second separator 50 operates to separate the water from the mixture of water and natural gas present in second pipeline 45. Hence, the second separator 50 directs water to water tank 98 via fifth pipeline 80, while passing the remaining natural gas to the compressor 70 via third pipeline 60.

Generally, monitoring units 100, 110, 120, 130 are placed at multiple places at the well site on or in the equipment to be monitored. The monitoring units may be placed on the gas/oil well head, product separator, gas hub, gas hydrogenater, oil and water tank. Since the gas/oil well is located within the "danger zone" 20, monitoring unit 100 should possess certain safety characteristics. In general, any monitoring unit within the "danger zone" 20 should be substantially gas tight and substantially explosion proof as determined by certain standards as are known to those of skill in the art, such as, for example, meeting Class 1 standards.

A monitoring unit monitors and controls different sensors depending on its function and location (placement) at the gas/oil well site. They may monitor such characteristics as temperature, volume and pressure as well as, alarm states in the system, among others. Additional monitored information may include, but is not limited to, tank level and flame detection. Commercially available sensors are typically employed for these monitoring functions. Such sensors are available, for example, from BEI Technologies, Inc. (San Francisco, Calif.), Honeywell Industries, Ashcroft® (Stratford, Conn.), Barksdale (Los Angeles, Calif.), Physical Sciences, Inc. (Andover, Md.) and Measurement Specialties, Inc. (Norristown, Pa.). In the preferred embodiment, up to six (6) sensors may be connected to each monitoring unit. Each monitoring unit may also have two outputs for controlling external systems, such as cutoff valves or control relays.

The monitoring units 100, 110, 120 and 130 all monitor one or more conditions or features of the equipment to which they are attached. For example, monitoring unit 100 is connected to the gas/oil well 10 and typically monitors two pressures: the pressure inside the inner tubing and the pressure between the outer and inner tubing. Monitoring unit 110, connected to natural gas pipeline 60, typically monitors the pressure of the third pipeline 60, the temperature of the natural gas, and the differential pressure on each side of a restrictor plate. With this information, natural gas flow rate can be determined as is known by those of skill in the art. Monitoring unit 120, connected to oil tank 95, measures the pressure at the bottom of the tank. With that information, as well as the diameter of the oil tank 95 and the specific gravity of the oil in the oil tank 95, the amount of oil in oil tank 95 can be determined by a formula as is known to those of skill in the art. Likewise, monitoring unit 130, connected to water tank 98, measures the pressure at the bottom of water tank 98. With that information, as well as the diameter of the water tank 98 and the specific gravity of water, the amount of water in water tank 98 can be determined by a formula as is known to those of skill in the art. In each case, additional sensors can be used, e.g., trip level sensors in the tanks. Other methods of measuring can be used, such as, infrared, microwave and float sensors. The information gathered by the monitoring units is transmitted to the relay unit and then to the host interface.

The monitoring units 100, 110, 120 and 130 are energy efficient radio frequency (RF) transceivers. In one embodiment, their function is to transmit and receive messages over a 916.50 MHz carrier for short distances. In other embodiments, the carrier frequency can be 433 MHz or 575 MHz or spread spectrum. Generally, the carrier frequency is any frequency range approved by a governmental agency governing the locale in which the monitoring unit resides. Generally, the RF transceivers are very low power transceivers. In one embodiment, where the RF transceiver is within the "danger zone" 20, the transmitter of the RF transceiver preferably uses at most 0.75 mW of energy. Such a low amount of energy does not present an ignition source. Preferably, energy up to 1 mW is generally accepted as not presenting a safety hazard in the "danger zone" 20. The use of a higher power transmitter, such as a cellular phone, would typically present a possible ignition source.

The data collected by the monitoring unit is sent to a relay unit 140 that, in turn, transmits the information to a host interface (not shown in FIG. 1) via a communication network such as a cellular network or a land line telephone network. Each of the monitoring units 100, 110, 120 and 130 is also capable of receiving data from relay unit 140. Relay unit 140 can query each, some or all of the monitoring units 100, 110, 120 and 130 or receive data and requests from each, some or all of them.

Thus, relay unit 140 is designed to be a gateway between the monitoring units 100, 110, 120 and 130 and host interface (not shown in FIG. 1). Preferably, the relay unit 140 transmits and receives messages to and from the host over a different frequency carrier than that used for communication between the relay unit 140 and the monitoring units 100, 110, 120 and 130. Relay unit 140 is located outside the "danger zone" 20 and generally elevated. Preferably, relay unit is located on a pole 150. Since the relay unit 140 is outside the "danger zone" 20, the relay unit can use higher power communications such as cellular communications to communicate with the host interface without being a safety hazard.

Figure 2:
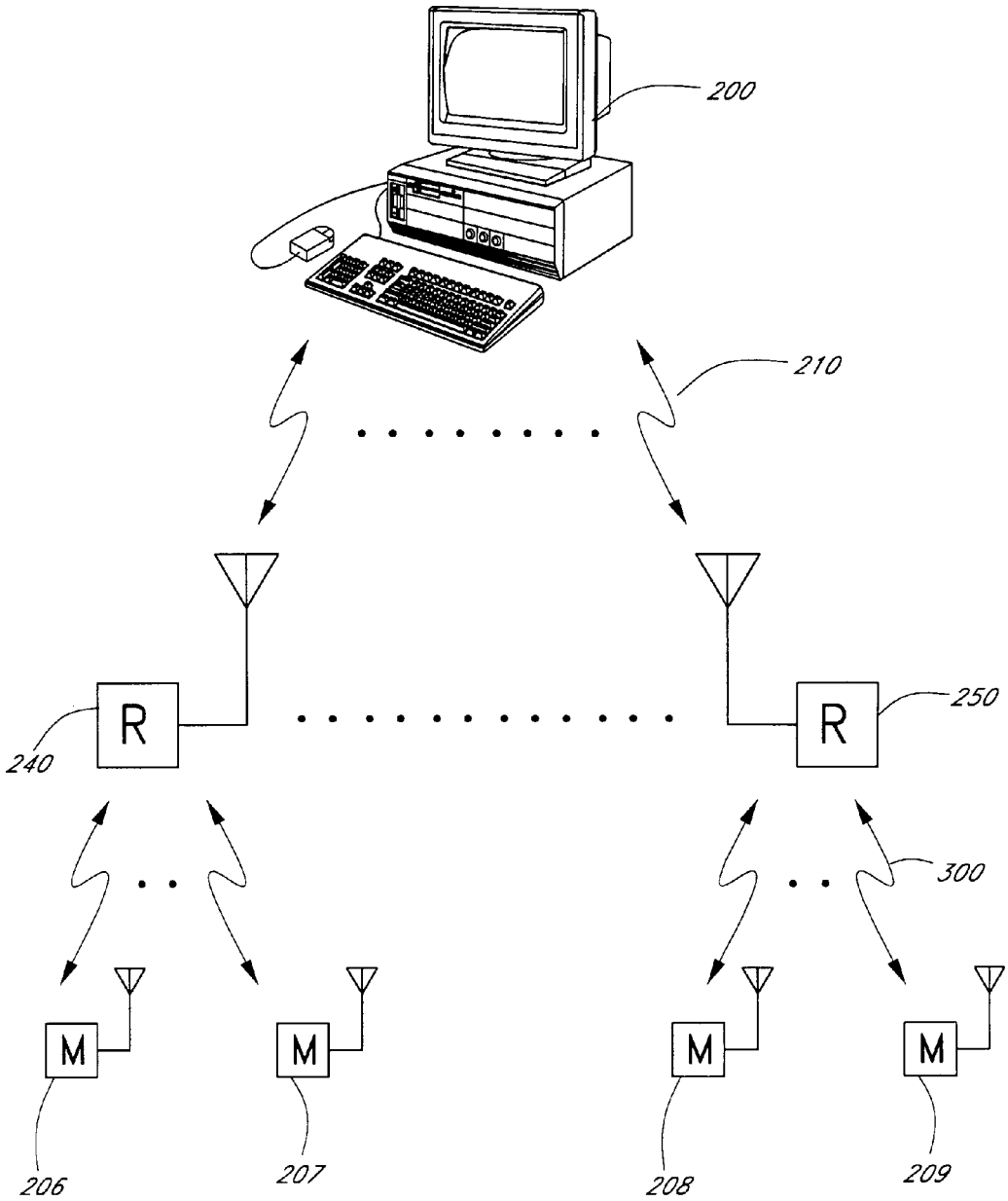
FIG. 2 illustrates a block diagram of the communications systems, according to aspects of an embodiment of the invention.

FIG. 2 illustrates a block diagram of the general communication systems, according to aspects of a preferred embodiment of the invention. As can be seen in FIG. 2, a plurality of monitoring units 206, 207, 208, 209 communicate with a plurality of relay units 240, 250 via RF links 300. Each relay unit 240, 250 communicates to a host interface 200 (or a plurality of host interfaces) via cellular phone lines, land phone lines, satellite link, microwave, Internet or the like. In this embodiment, the host interface 200 communicates to the relay unit 240 via a landline.

Host Interface

In the preferred embodiment, the host interface 200 is a computer. The computer is a device that allows a user or a computer network to interact with the relay units 240, 250 as well as other communication mediums. In one embodiment, the user computer is a conventional general purpose computer using one or more microprocessors, such as, for example, a Pentium processor, a Pentium II processor, a Pentium Pro processor, an xx86 processor, an 8051 processor, a MIPS processor, a Power PC processor, or an Alpha processor. In one embodiment, the user computer runs an appropriate operating system, such as, for example, Microsoft® Windows® 3.X, Microsoft® Windows 98, Microsoft® Windows® NT, Microsoft® Windows® Me, Microsoft® Windows® 2000, Microsoft® Windows® CE, Palm Pilot OS, Apple® MacOS®, Disk Operating System (DOS), UNIX, Linux®, or IBM® OS/2® operating systems. In one embodiment, the user computer is equipped with a conventional modem or other network connectivity such as, for example, Ethernet (IEEE 802.3), Token Ring (IEEE 802.5), Fiber Distributed Datalink Interface (FDDI), or Asynchronous Transfer Mode (ATM). As is conventional, in one embodiment, the operating system includes a TCP/IP stack that handles all incoming and outgoing message traffic passed over the communication medium.

In other embodiments, the host computer may, for example, be a computer workstation, a local area network of individual computers, an interactive television, an interactive kiosk, a personal digital assistant, an interactive wireless communications device, a handheld computer, a telephone, a router, a satellite, a smart card, an embedded computing device, or the like which can interact with the communication medium. While in such systems, the operating systems will differ, they will continue to provide the appropriate communications protocols needed to establish communication links with the communication medium.

Focusing now on the communication medium used to interconnect the host computer with a wider computer network, the presently preferred other communication medium includes the Internet which is a global network of computers. The structure of the Internet, which is well known to those of ordinary skill in the art, includes a network backbone with networks branching from the backbone. These branches, in turn, have networks branching from them, and so on. Routers move information packets between network levels, and then from network to network, until the packet reaches the neighborhood of its destination. From the destination, the destination network's host directs the information packet to the appropriate terminal, or node. For a more detailed description of the structure and operation of the Internet, please refer to "The Internet Complete Reference," by Harley Hahn and Rick Stout, published by McGraw-Hill, 1994.

In one advantageous embodiment, the Internet routing hubs comprise domain name system (DNS) servers, as is well known in the art. DNS is a Transfer Control Protocol/Internet protocol (TCP/IP) service that is called upon to translate domain names to and from Internet Protocol (IP) addresses. The routing hubs connect to one or more other routing hubs via high speed communication links.

One of ordinary skill in the art, however, will recognize that a wide range of interactive communication mediums may be employed in the present invention. For example, the communication medium may include interactive television networks, telephone networks, wireless data transmission systems, two-way cable systems, customized computer networks, interactive kiosk networks, automatic teller machine networks, and the like.

One popular part of the Internet is the World Wide Web. The World Wide Web contains different computers that store documents capable of displaying graphical and textual information. The computers that provide information on the World Wide Web, are typically called "websites." A website is defined by an Internet address that has an associated electronic page. A Uniform Research Locator (URL) can identify the electronic page. Generally, an electronic page is a document that organizes the presentation of text, graphical images, audio, video, and so forth.

For example, one type of electronic page format includes a set of electronic page documents that are typically written in HTML code (Hypertext Markup Language). Standard HTML documents contain HTML code as well as client side scripts. Server script programs are not contained in the HTML document, but stored as a separate set of programs as script programs. In the exemplary component, the web documents contain HTML code and client side scripts and the script programs are accessed separately. For example, when the user makes a request from electronic page document, the component finds the appropriate script program, and runs that appropriate script program.

Each of the monitoring units, relay units and host interfaces include logic embodied in hardware and/or firmware, or in a collection of software instructions, possibly having entry and exit points, written in a programming language, such as, for example, C++. These instruction strings are often referred to as modules or components. A software module may be compiled and linked into an executable program, or installed in a dynamic link library, or may be written in an interpretive language such as BASIC. It will be appreciated that software modules may be callable from other modules or from themselves, and/or may be invoked in response to detected events or interrupts. Software instructions may be embedded in firmware, such as an EPROM. It will be further appreciated that hardware modules may be comprised of connected logic units, such as gates and flip-flops, and/or may be comprised of programmable units, such as programmable gate arrays or processors. The modules described herein are preferably implemented as software modules, but may be represented in hardware or firmware.

Additionally, the monitoring units, relay units and host interfaces may include a graphical user interface, which is a software program that uses text, graphics, audio, video and other media to present data and to allow interaction with the data. A graphical user interface may be a combination of an all points addressable display such as a cathode-ray tube (CRT), a liquid crystal display (LCD), a plasma display, or other types and/or combinations of displays; input devices such as, for examples, a mouse, trackball, touch screen, pen, keyboard, voice recognition module, and so forth; and software with the appropriate interfaces which allow a user to access data through the use of stylized screen elements such as, for example, menus, windows, toolbars, controls (e.g., radio buttons, check boxes, sliding scales, etc.), and so forth.

The host interface 200 operates to communicate information gathered from the monitored site to a user. Typically, a user would like to know certain information (such as, the level of oil in the oil tank 95) on a daily basis. Thus, the host interface operates to collect and display such information. The information is communicated from the monitoring unit through the relay unit to the host interface. The host interface can download that information for local storage or relay that information to another party (via fax, telephone, email, telefax, pager, or any type of cellular equipment) or to another computer or network. Additionally, the host interface 200 may be used by a service that collects information about a gas/oil well or several gas/oil wells. The service can then relay an information to an end user computer, phone, fax, email, pager, telefax or any other type of cellular equipment.

Relay Unit

Figure 3:
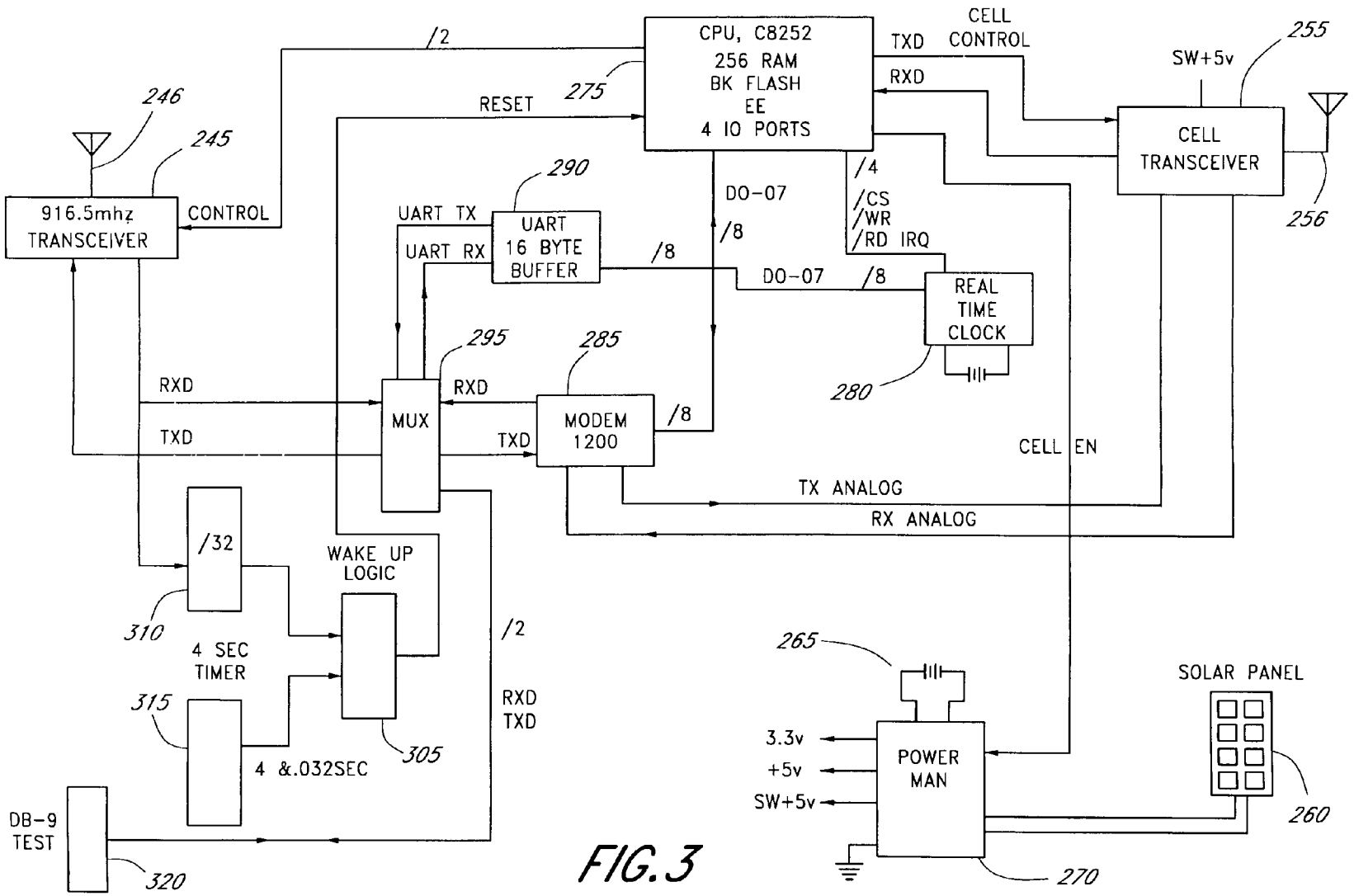
FIG. 3 illustrates a block diagram of the relay unit, according to aspects of an embodiment of the invention.

FIG. 3 is a block diagram of the components of the preferred embodiment of the relay unit 240 of the present invention. The relay unit 240 comprises a transceiver 245 (and accompanying antenna 246) to communicate with monitoring units, a cellular transceiver 255 (and accompanying antenna 256) to communicate with the host interface 200, a solar panel 260 for power, a battery 265, a power manager 270, a CPU (central processing unit) 275, a clock 280, a modem 285, a UART (Universal Asynchronous Receiver/Transceiver) 290, a multiplexer 295, wake up logic 305, and timers 310, 315. Additionally, the relay unit 240 may include test pins 320, for use in debugging or interfacing with the relay unit 240. Those of skill in the art understand these components, their uses and various interconnections. Also, the skilled artisan will appreciate that different parts and interconnections can be used to achieve the same results. For example, CPU 275 is preferably an Intel C51 processor. A Zilog 80xx processor, however, can also be used.

The relay unit 240 has a battery 265, which can be a gel, Nicad or lithium battery. Alternatively, the relay unit 240 can be designed to work off of an AC power supply. Battery 245 typically has a life of approximately five years. Solar panel 260 can be used to charge the battery 245. Even without sunlight, however, the relay unit can remain operational for seven days by running off the battery, before running out of power. The status of the battery 265 level can be transmitted to the host interface 200. Preferably, the battery level is transmitted to the host interface only if it is lower than a set threshold. Likewise, the relay unit 240 can communicate to the host interface 200 that the battery 245 is being charged.

Typically, the relay unit 240 conserves power by mostly remaining in a "sleep" mode, where only minimal circuitry is using power and the CPU 275 is off. The minimal circuitry that is active while in the "sleep" mode is the timers 310,315. This minimal circuitry allows for the transceiver to be operational for 32 ms every 4 seconds. When the relay unit 240 "wakes up," the CPU is powered up to process some task(s) (as will be described in greater detail below).

The relay unit 240 is designed as a gateway to handle page-ins and call-outs to the host interface through a communication medium such as a cellular interface. Preferably, the communication medium is secure through the use of encryption technology, as the skilled artisan can appreciate. After the relay unit 240 is connected to the host interface 200, the host interface 200 can configure, control or request data from the relay unit 240 or any monitoring unit at the gas/oil well site. Call-outs are alarms or data reports (e.g., twenty-four (24) hour site readings) to a host interface, whereas page-ins are control (or data) requests and configurations from a host interface. The host interface may communicate different types of page-ins, including but not limited to, (1) alarms to inform field service (or a designated service company) of a service need, (2) data requests from an accounting department (e.g., flow of natural gas), and (3) configurations and controls from engineering/service personnel (e.g. take a monitor unit off line).

Generally, the relay unit 240 collects data from monitoring units and calls the host interface through its cellular transceiver 255 and waits for a proceed command from the host interface 200. This will allow variable connect delays to be transparent to a protocol. Once an "ACK" is received from the host interface 200, messages may be sent out by the relay unit 240. Preferably, messages are single text lines ending in a carriage return, line feed. Other communication protocols can be used as are known to those of skill in the art.

The relay unit has a real time clock 245 that can initiate events from seconds to minutes to days to months and years. This highly accurate clock 245 may be controlled remotely by several techniques: (A) the host interface 200 can read and set the clock, (B) the relay unit 240 can set (or be set) to wake up at a certain time (perhaps periodically, daily or weekly or monthly) and dial into the host interface to determine the proper state of the clock, or (C) the monitoring unit may inform the relay unit of the proper state for the clock (or to tell the relay unit to dial up the host interface as in (A)).

Preferably, there are three "wake up" situations for the relay unit 240. First, a monitoring unit can send an alarm signal to the relay unit 240 to wake it up. Here, the RF transceiver 245 receives a signal from the monitoring unit and sends a receive signal to the wake up logic 305. In all cases, the wake up logic 305 sends a power up signal to the CPU 275 to wake the CPU 275 up in order for the CPU 275 to process the alarm message. Second, the clock 280 can be used by the wake up logic to determine a time to wake up. Third, a monitor or computer can be connected to test pins 320 and thereby wake up the CPU 275. The monitor or computer can be connected to the relay unit 240 for maintenance, programming or service. The relay unit can also be configured to wake up on demand by a call from the host interface.

Relay units may be configured to do any of these "wake ups" and to alter their alarm time intervals. This allows given periods for daily data dumps from monitoring units to the host interface 200 via the relay unit 240 and/or host interface 200 queries to monitoring units via the relay unit 240, both at any time interval. Preferably, the default setting for the relay unit 240 is to commence data dumps to the host interface at twelve (12) AM (midnight) each day and to wake up and await for host interface queries every 30 minutes for 2 minutes.

The relay unit's hardware actuates the reset pin, RST, to do "transmits" (or "receives") and the software executes a power down when it has finished the events. Another function of the relay unit is to determine what type of "wake up" is being sent. If the "wake up" signal is a RTC timer wake up, the relay unit wakes up and then dials out to the monitoring units to get and process data. If the "wake up" call is from the host interface, the relay waits for instructions from the host interface following the wake up. Another type of wake up is an RF "wake up" pattern sent by the monitoring unit to relay unit. After the relay unit receives an RF "wake up" pattern, the relay unit wakes up and processes the alarm.

In one embodiment, the relay unit transmits the data directly to an end user, through a communication source such as a cellular phone or the Internet. In another embodiment, the functionality of the relay unit and the host interface could be combined and resident at the relay unit.

Monitoring Unit

FIG. 4 is a block diagram of the monitoring unit of the preferred embodiment of the present invention. The monitoring unit 400 includes a sensor interface 405. The sensor interface 405 can connect the monitoring unit 400 to at least one sensor (not shown) that monitors some aspect of the equipment to which the sensor is attached. Through the sensor interface 405, the monitoring unit 400 can supply power and ground to the sensor. The sensor interface 405 can also include at least one output. Preferably, two outputs are included in the sensor interface 405 to allow for alternate signals to turn on and off a sensor. These outputs are driven by drives 416,417. Thus, the monitoring unit 400 can use drivers 416,417 to send information to sensors, such as serial interface information. Similarly, op-amp 412 can amplify or buffer any inputs coming from the sensor interface 405. Op-amp 412 can be programmable. Inputs directly from the sensor interface 405 or via op-amp 412 are routed to a multiplexer 415 that places information from the sensors on a digital or analog bus for access by the CPU 420. The monitoring unit includes a RC circuit 450, timers 458, 459, a serial decoder/latch 460, transceiver 435 and an antenna 436. Those of skill in the art readily understand these components, their uses and various interconnections. Also, the skilled artisan will appreciate that different parts and interconnections can be used to achieve the same results. For example, CPU 420 is preferably an Atmel® 89C55WD or any C51/2 type processor. Any basic CPU, such as another 8 bit CPU, for example, can also be used.

The monitoring unit also includes power logic 440 to monitor and provide stable power to the board. The power logic is attached to a battery. Preferably, two 3.3 volt Lithium batteries 441, 442 are connected in series to a connector 443 that interfaces with the power logic 440. Various types of batteries can be used as long as they possess sufficient life and a wide enough temperature operating range. Batteries 441, 442 typically have a life of approximately ten (10) years. The status of the batteries 441, 442 can be transmitted to the host interface 200. The level of the batteries can be read often or infrequently as determined by the user. Preferably, the battery level is transmitted to the host interface only if it is lower than a set threshold. Typically, the monitoring unit 400 conserves power by mostly remaining in a "sleep" mode, where only minimal circuitry (e.g., the hardware timer 458, which typically uses less than 1 $\mu$A) is consuming power and the CPU 420 is powered off. In the sleep mode, the timer 458 turns on the transceiver 435 for a short period of time to monitor for a wake up signal. Preferably, the transceiver 435 is turned on for 32 ms every 4 seconds. When the monitoring unit 400 "wakes up," the CPU is powered up to process some task(s) (as will be described in greater detail below).

The monitoring unit 400 also has a dip switch 445. The dip switch 445 can be used to set the ID of the monitoring unit as well as to program the function of the monitoring unit or to program the op-amp 412. The dip switch 445 is typically set at installation. The dip switch can also identify what types of sensor it is attached to or if the monitoring unit is acting as a repeater. The CPU 420 reads the dip switch every time the CPU 420 wakes up. If the dip switch 445 has changed since the last time the CPU read it, the monitoring unit reports that change on its next transmission.

Generally, the monitoring units handle such sensing as tank level reads, for example. The monitoring units are configured at installation with firmware and hardware to automatically detect the presence of the sensors connected to it. These monitoring units are normally asleep unless awakened by an alarm state, a timed wake up or an RF wake-up transmission.

The first type of "wake up" is by alarm. Sensors attached to a monitoring unit can be of the type that report an alarm. An example of this would be a level sensor on an oil tank. For example, if the oil tank is 20 feet tall, a level sensor can be set to determine when the oil in the tank reaches 18.5 feet. When the sensor detects that the oil has reached 18.5 feet, it sends an alarm signal to the monitoring unit. That alarm signal enters the sensor interface connector 405 and is latched at the alarm latch 425. The alarm latch 425 provides the alarm signal to the wake up logic 430, which then sends a reset command to the CPU 420. Once the CPU 420 receives the reset command, the CPU powers up and processes the alarm.

The third type of wake up is by receiving an RF wake-up transmission from a relay unit 240. When the transceiver 435 receives a wake-up transmission, a signal is sent from the transceiver 435 to the wake up logic 430, which then sends a reset command to the CPU 420. Once the CPU 420 receives the reset command, the CPU powers up and processes the incoming transmission.

The monitoring unit 400 can also be configured to "wake up" on a timed basis, or by being connected to serial data port on a computer through connector 405.

Sensing

Each monitoring unit has sensor inputs. With reference to FIG. 4, the sensor interface connector 405 connects inputs from sensors (not shown) through a multiplexer 415 to an analog to digital converter that is resident on the CPU 420. Preferably, any sensor type that provides 0–5 volt output may be used in conjunction with the monitoring unit. Other sensors, such as those using 0–9 volts or 4–20 mA, can also be used. By way of example, sensor inputs into the monitoring unit may include, but are not limited to: temperature readings (−40° C. to +70° C.); configured for alarms; flow rate; or tank level. Other sensor inputs can include: alarm on tank level, rate of fill, drop in level (loss), pipe pressure, differential pressure, alarm on over/under rate of flow, high resolution profile of any variable on demand, compressor shutoff, infrared flame detector, external alarm (such as a tamper alarm), motion sensor, normally open dry contacts and battery life.

For high resolution profile, the monitoring unit reads a port from the sensor interface connector 405 every 100 ms for three (3) minutes, which results in 1800 reads. Then, the monitoring unit sends that information to the relay unit in real time. Thereafter, the relay unit calls the host interface and dumps that data. Once the host interface has that information, it can inform the monitoring unit of minimums and maximums that it would like to set as an alarm condition. The monitoring unit then compares its measured flow rate to the min/max sent to it by the host interface. If the new flow rate is within the limits, the monitoring unit averages the new flow rate reading and sends that information to the relay unit. This can also be done with the temperature reading. Furthermore, the duration of the reading or its frequency can be modified to suit the needs of the user.

The monitoring unit can also provide outputs to sensors through the sensor interface connector 405. By way of example, two driven outputs can be controlled by information sent by the host interface (via the relay unit and CPU on the monitoring unit). The driven outputs can provide short pulses of +5 volts, +6 volts, or +12 volts. These low current pulses may be used to latch a relay or turn pressure valve on or off. Additionally, serial interface information could be outputted.

Monitoring unit 400 includes in its transmission a battery status and an analog to digital reference. The passing of the analog to digital reference permits the host interface 200 to compensate for the analog to digital conversions. For example, the analog to digital reference can change with temperature and thus affect the readings at the monitoring unit 400. With knowledge of the analog to digital reference, the host can correct the data coming to it from the monitoring units.

The maximum distance between a monitoring unit and a relay unit (without a repeater) is approximately 500 feet, line of sight. Any monitoring unit may be configured as a repeater to extend the range as desired.

Transceivers

Figure 5:
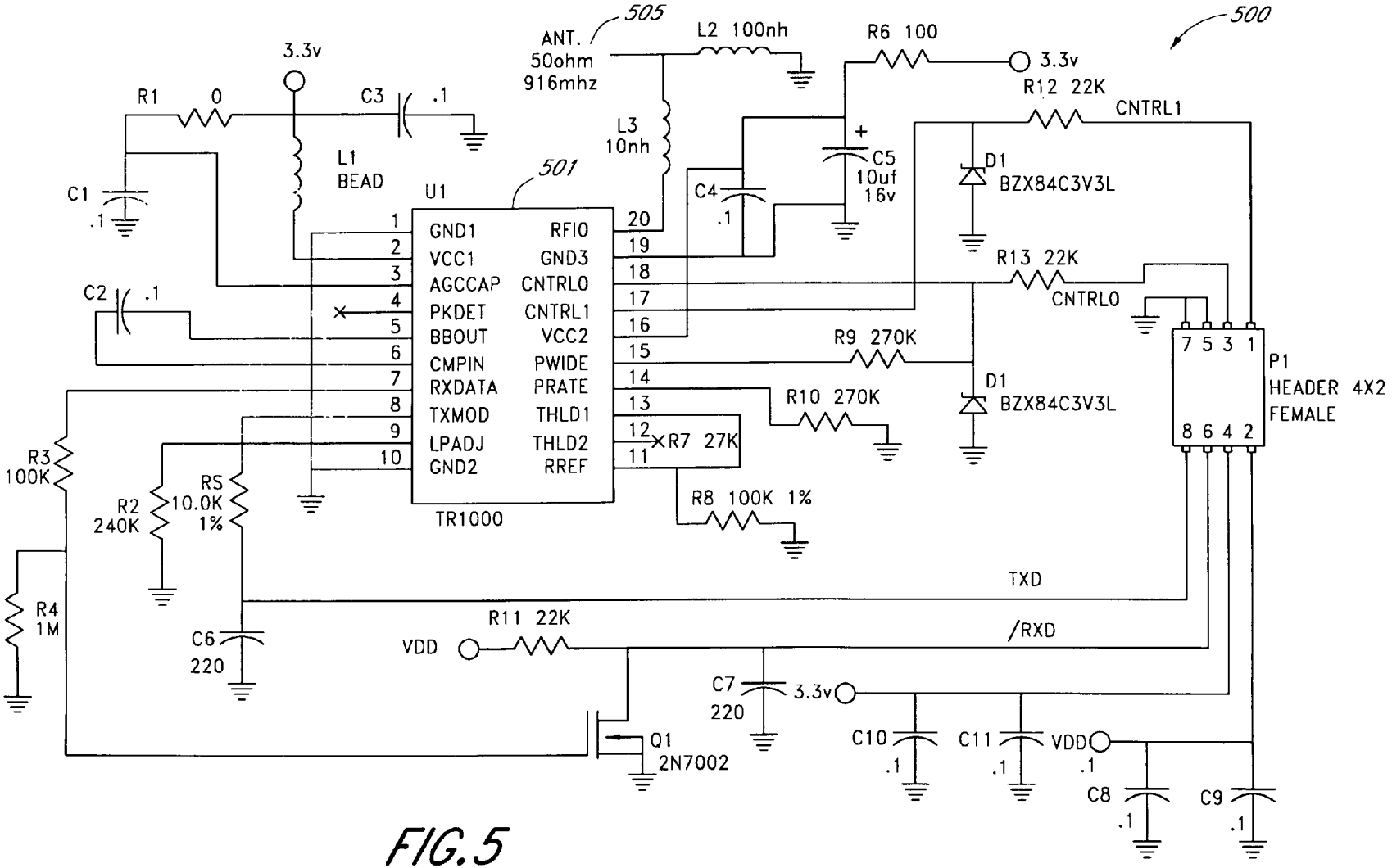
FIG. 5 illustrates a schematic diagram of the transceiver, according to aspects of an embodiment of the invention.

FIG. 5 is a schematic diagram of a transceiver 500 that can be used in both the relay unit 200 and the monitoring unit 400. Specifically, transceiver 500 is designed to send and receive RF signals. Transceiver 500 is designed for short-range wireless data communications. The transceiver 500 utilizes a transceiver chip 501. Preferably, the transceiver chip is a TR1000 hybrid transceiver chip (available from RF Monolithics, Dallas, Tex.). The antennae 505 is 50 ohms and can be connected to ground by one inductor L2 and to the receive and transmit pin of the chip 505 by inductor L3. The antenna is preferably about a quarter wavelength long and is the size of a paper clip. Preferably, the antenna 505 has a waterproof PVC shell. Those of skill in the art can readily appreciate these components, their uses and various interconnections. Also, the skilled artisan will appreciate that different parts and interconnections can be used to achieve the same results. For example, other types of transceiver chips could be used, such as RF ICs from National Semiconductor or Motorola.

Monitoring Unit Housing

Figure 6A:
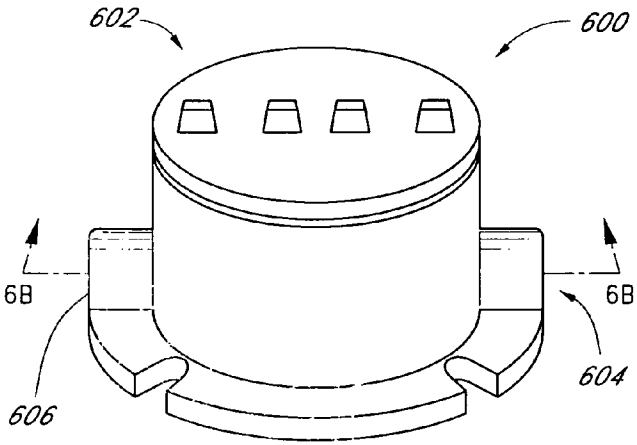
FIG. 6A illustrates a pan view of the monitoring unit housing, according to aspects of an embodiment of the invention.

FIGS. 6A–D depicts the monitoring unit housing 600. Specifically, FIG. 6A is a pan view of a typical monitoring unit housing 600. The monitoring unit housing should meet gas tight and explosion proof standards, such as Class 1, if it is in the "danger zone" 20. Such a monitoring unit housing 600 would comply with safety measures necessary for the "danger zone" 20. Preferably, the monitoring unit housing 600 is made of aluminum and has a small weight and height. An acceptable monitoring unit housing 600 is an explosion proof electrical housing such as model GRFC75-A, GRFT75-A or GRFX-75A available from Appleton Electric Company (Chicago, Ill.).

With continuing reference to FIG. 6A, the monitoring unit housing 600 has a cover 602 which allows access to the hollow inside of the monitoring unit housing 600. The cover 602 also provides a gas tight seal. The monitoring unit housing 600 has inlets 604, 606 that allow for sensors or pipes to be screwed into the monitoring unit housing. The number of inlets and sensors attached to the monitoring housing unit is dependent upon the specific uses of the monitoring unit. For example, only two inlets are needed to accommodate a temperature sensor and an RF transceiver (as is discussed below). Additional inlets may be needed for additional sensors, such as flow rate sensors.

Figure 6C:
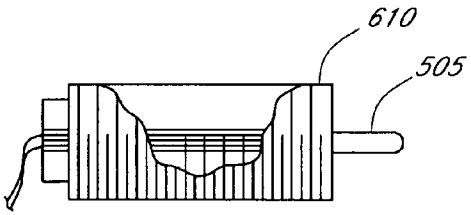
FIG. 6C illustrates a view of the transceiver pipe with a cutout, according to aspects of an embodiment of the invention.
Figure 6D:
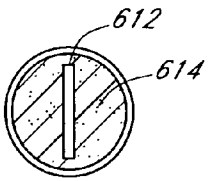
FIG. 6D illustrates a cross-sectional view of the transceiver pipe taken across lines 6D–6D, according to aspects of an embodiment of the invention.
Figure 6B:
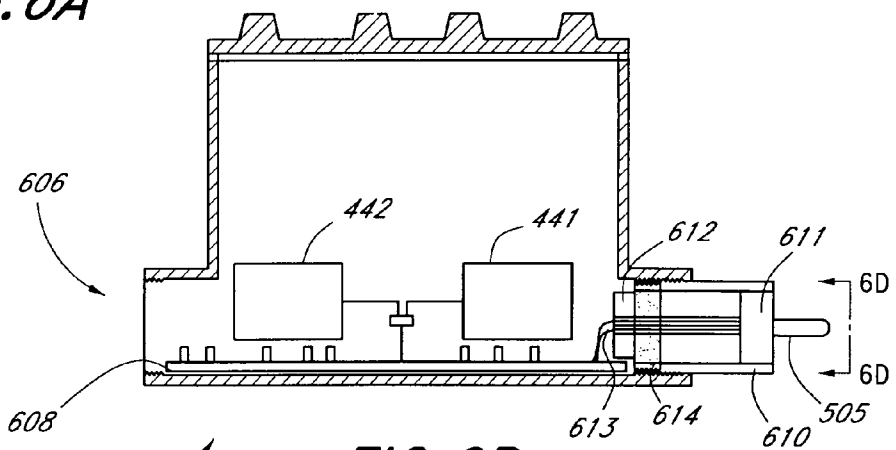
FIG. 6B illustrates a cross-sectional view of the monitoring unit housing taken across lines 6B–6B, with a transceiver pipe inserted, according to aspects of an embodiment of the invention.
Figure 9:
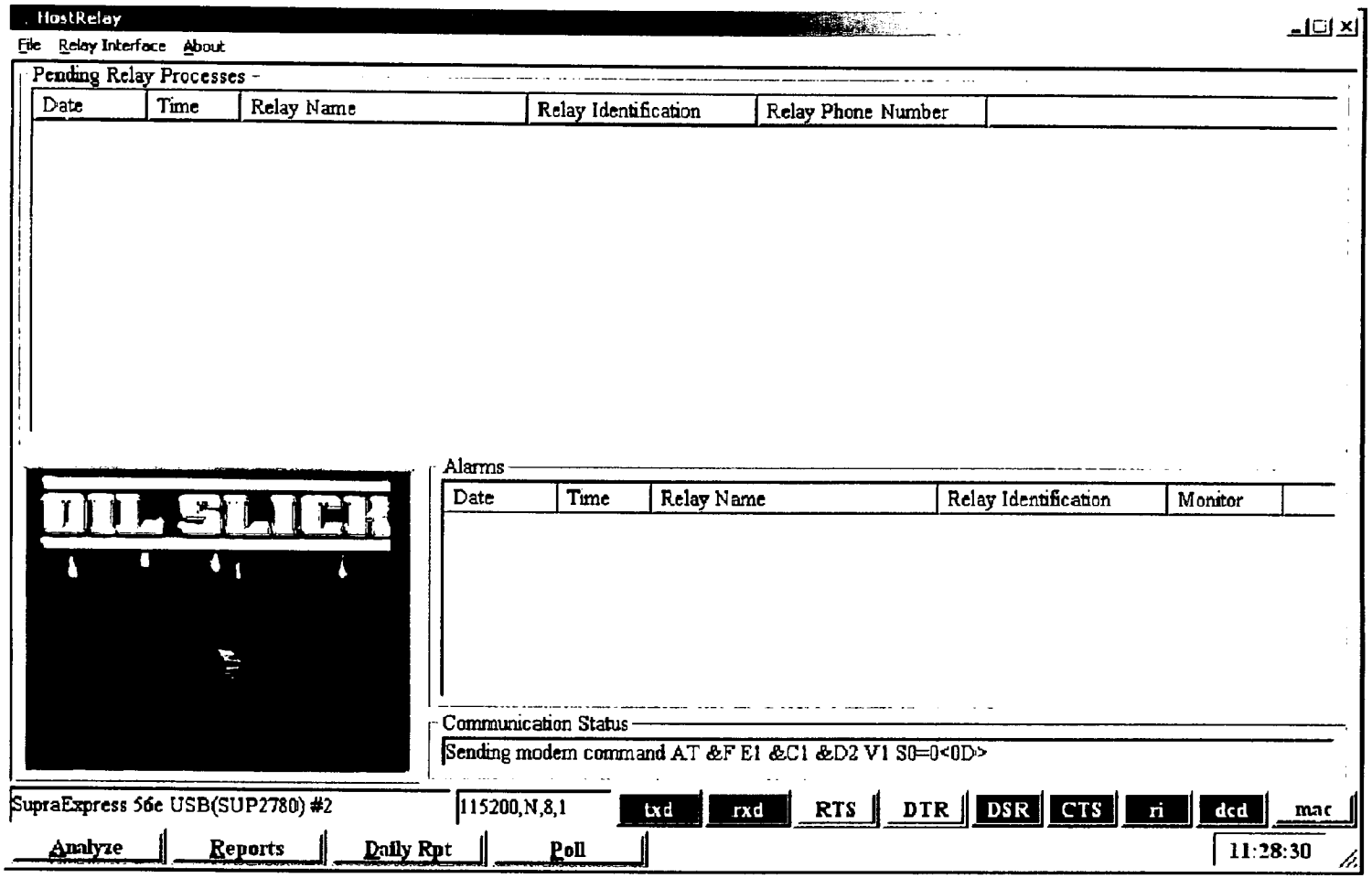
FIG. 9 illustrates a screen shot of a user report.
Figure 10:
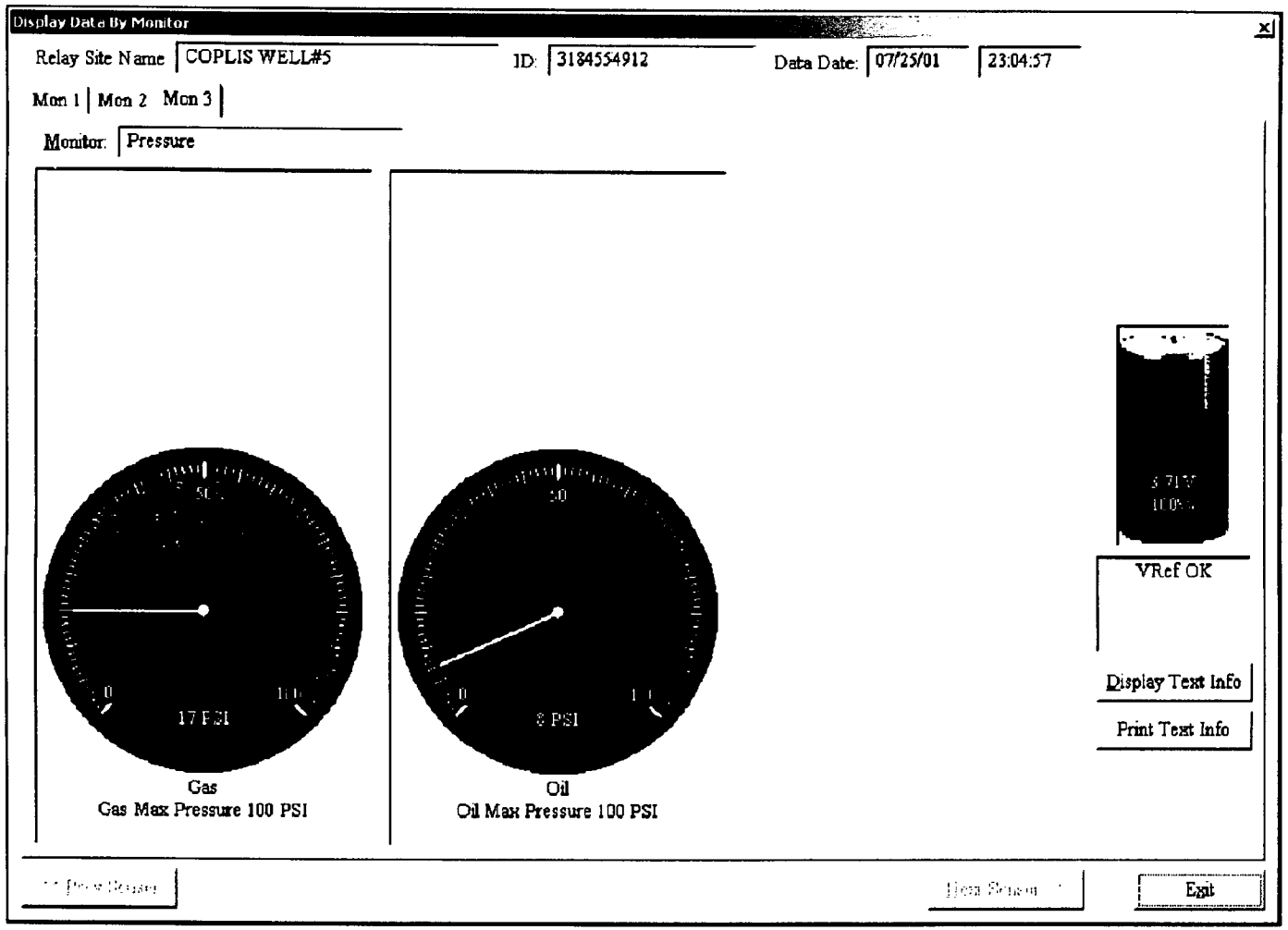
FIG. 10 illustrates a screen shot of a user report.
Figure 11:
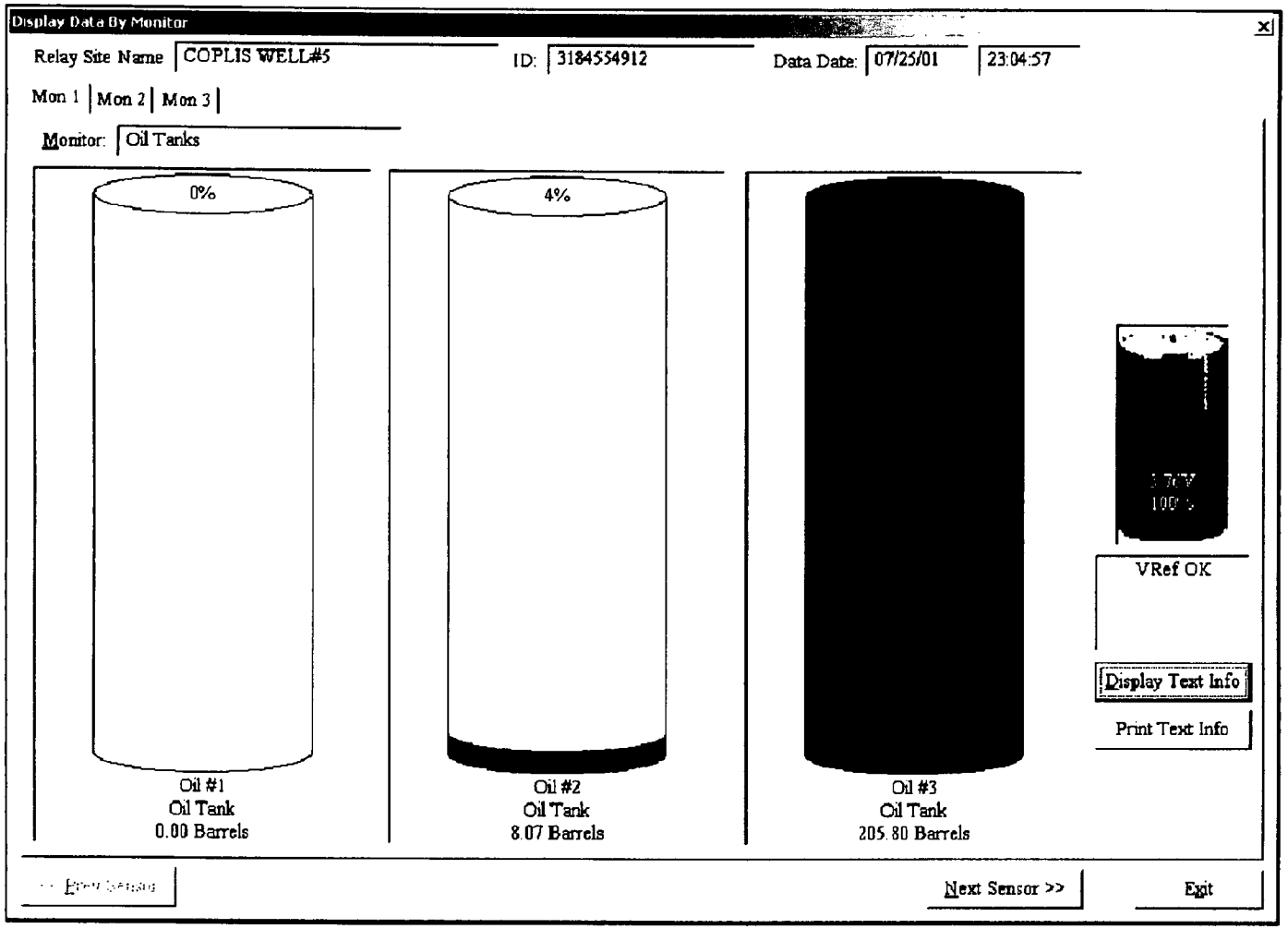
FIG. 11 illustrates a screen shot of a user report.

FIG. 6B, is a cut-away view of FIG. 6A along lines 6B—6B with an RF pipe 610 inserted. Within the monitoring unit housing 600, batteries 441 and 442 connect to connector 443 that in turn connects to the monitoring unit circuit board 608. Additionally, RF pipe 610, which houses the RF transceiver board 612, is screwed into the monitoring unit housing 600. The monitoring unit board 608 is shaped to fit at the bottom of the monitoring unit housing 600. Additionally, the monitoring unit board 608 is bolted down and grounded.

The seal between the RF pipe 610 and the monitoring unit housing 600 is made gas tight by the fastening. At the end of the RF transceiver board 612, there is a connector (not shown) that interfaces to a ribbon cable 613 that in turn interfaces to the monitoring unit board 608. The RF transceiver board 612 has copper traces that run from the connector to an RF circuit 616 that connects to the antenna 505.

The circuitry within the monitoring unit housing 600, which generally processes the sensor information, is an ignition source and a safety hazard. Additionally, the batteries 442,441 could generate enough heat to be a safety hazard as well. Because of this hazard, it should be contained within the monitoring unit housing 600.

With reference to FIGS. 6B, 6C, and 6D, RF pipe 610 holds the RF transceiver board 608 within it with epoxy 614. The epoxy allows for a gas tight, explosion proof seal to be formed since it completely occupies a section of the RF pipe, forming a barrier between the outside and the inside of the monitoring unit housing 600. Thus, RF signals are substantially attenuated by the epoxy seal 614. Consequently, RF signals have to be received and transmitted outside the monitoring unit housing 600. By the use of the epoxy 614, signals along the copper trances can go back and forth between the inside and outside of the epoxy barrier 614 without causing a safety hazard.

FIG. 6C, is a view of the pipe 610 shown in FIG. 6B with a cutout section. FIG. 6D is a cross-sectional view of the pipe in FIG. 6B taken along lines 6D—6D.

When the monitoring unit is located outside the "danger zone" 20 and does not need to be gas tight and explosion proof, the above strict safety measures do not need to be followed. It should, however, be waterproof and very durable. Thus, the monitoring unit housing may be modified accordingly. For example, instead of having sensor pipes screw into the monitoring unit housing, standard three (3) feet long interconnect cables can be used to connect sensors to the monitoring unit housing through inlets. Such cables can be double Teflon® (Dupont®) wrapped in stainless steel armor. This is required for resistance to environmental effects, acids, oil, salt and water.

Since the relay unit is outside the "danger zone" 20, it need not adhere t strict safety standards. Thus, the relay unit housing should be waterproof and durable.

EXAMPLES

Generally, the originating device directs the message flow of communication. As described above, message flow may be originated by the monitoring unit, relay unit or host interface. Below are some examples of message flow of some embodiments of the invention.

Communications Between the Host Interface and Relay Unit

The host interface 200 can originate message flow by contacting the relay unit 240. The host interface 200 calls the cellular phone of the relay unit 240 or uses a communication medium, such as a landline. Although the relay unit 240 can be kept powered up, due to power concerns, the relay unit 240 is normally in a sleep mode. While in this sleep mode, however, the host interface 200 periodically wakes up and awaits host interface 200 queries every thirty (30) minutes for two (2) minutes. Once the host interface 200 has contacted the relay unit, it can request data from the monitoring units or send control information to the relay unit or monitoring units or set configurations at the relay unit or monitoring units. Additionally, the host interface 200 may communicate other types of page-ins, including but not limited to, data requests from an accounting department (e.g., flow of natural gas) and configurations and controls from engineering/service personnel (e.g., take a monitor unit off line).

In either case, the host interface 200 communicates with the relay unit 240, which in turn communicates with the monitoring units.

After receiving information from the monitoring units, the relay unit calls the host interface through its cellular transceiver 255 or landline and waits for a "proceed" command from the host interface 200. This will allow variable connect delays to be transparent to a protocol. Once an "ACK" is received from the host interface 200, messages may be sent out by the relay unit 240. Preferably, messages are single text lines ending in a carriage return, line feed. Other communication protocols can be used as are known to those of skill in the art.

Communications Between The Relay Unit and Monitoring Unit

In one embodiment, after the relay unit has either awaken on its own (e.g. an internal clock time out is triggered for data uploading from the monitoring units) or received a transmission from a host interface (as described above), the relay unit 240 begins communications with the monitoring units. Preferably, the monitoring units are in a sleep mode. In this sleep mode, the monitoring unit's transceiver 435 is turned on for small periods of time (preferably, 32 ms every 4 seconds). Thus, the relay unit 240 transmits its message over its transceiver for a long enough period for all the monitoring units to be able to receive the transmission. The transmission of the relay unit 240 includes an RF "wake-up" sequence that is identified as a "wake-up" signal by the firmware in the monitoring unit.

A monitoring unit can become active when an RF "wake-up" sequence (described above) is detected. Each monitoring unit in a cluster can have a unique 4-bit address/configure ID that is added with a 4-bit command field to form a single address/command byte. This allows both input and output control by the host interface via the relay unit to any remote device at a site.

The RF wake-up sequence can be a series of ones and zeros to be identified as a "wake-up" signal by the firmware or hardware on the monitoring unit, instructing it to receive an incoming message. The RF wake-up sequence should be long enough to span the duty cycle of the monitoring unit's transceiver. The duty cycle of the monitoring unit's transceiver is preferably 32 ms on and 4 seconds off. During the 32 ms that the transceiver is on, it can receive a wake up signal.

After a relay unit 240 sends the RF wake-up signal, the next information sent is a data synchronization message followed by an instruction. The synchronization message resets an internal clock on each monitoring unit. Then, each monitoring unit waits a different amount of time before sending its transmission (of data) to the relay unit. The transmission is a packet including, but not limited to, the monitoring unit's ID, the command that was given to it and the data. This is sent to the relay unit three (3) times in a row. In this way, there is no overlap or collision of signal transmissions.

Then, the relay unit checks the three data packets to verify that at least two out of the three are the same. As the skilled artisan will observer, other verification techniques can be used. If the relay unit has verified the data packet, the relay unit 240 sends an acknowledge signal back to the monitoring unit. If the monitoring unit gets the acknowledge signal, it goes back to sleep. On the other hand, if it does not receive an acknowledge message, the monitoring unit will wait until all monitoring units have sent their data packets and then it resends its transmission.

In another embodiment, the host interface 200 communicates to the relay unit and identification of the monitoring units from which it is requesting information. The relay unit then can keep track of which, if any, monitoring unit did not transmit a message back to it. If the relay unit determines that a monitoring unit did not respond, the relay unit can specifically query that monitoring unit which has not responded. This function can be enabled/disabled from the host interface.

In another embodiment, the monitoring unit sends an alarm signal to the relay unit 240. After an alarm has awakened the monitoring unit, it begins transmissions with the relay unit 240. The monitoring unit's transmission includes an RF "wake-up" sequence. The RF wake-up sequence can be a series of ones and zeros to be identified as a "wake-up" signal by the firmware or hardware on the relay unit, instructing it to receive an incoming message. The RF wake-up sequence should be long enough to span the duty cycle of the relay unit's transceiver. The duty cycle of the relay unit's transceiver is preferably 32 ms on and 4 seconds off. During the 32 ms that the transceiver is on, it can receive a wake up signal.

After the RF wake-up signal is sent by a monitoring unit, the next information sent is a packet including, but not limited to, the monitoring unit's ID, the alarm and data. This is sent to the relay unit three (3) times in a row. Then, the relay unit checks the three data packets to verify that at least two out of the three are the same. As the skilled artisan will observer, other verification techniques can be used. If the relay unit has verified the data packet, the relay unit sends an acknowledge signal back to the monitoring unit. If the monitoring unit gets the acknowledge signal, it goes back to sleep. On the other hand, if it does not receive an acknowledge message, the monitoring unit repeats its transmission.

A variety of transmission formats and syntax can be used in the invention. For example, ASCII, hex data bytes or asynchronous 8N1 protocol can be used.

The firmware on the relay unit and monitoring unit is designed to start from power-up/reset, process a task and power down. Both for the relay unit and monitoring units, the hardware wakes up the processor and the firmware powers down the unit. This allows for long periods of no, or low power usage and therefore long battery life. Sleep-to-awake cycles, or 'duty cycles' are designed where power management is needed. This also reduces the cost since smaller batteries, smaller cases, smaller solar panels, and the like, can be used.

FIGS. 7–11 are examples of the types of reports that the host interface 200 can send to an end uses, such as a gas/oil well owner.

It is to be understood that not necessarily all objects or advantages described above may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein. For example, different encryption techniques and transmission protocols may achieve differing efficiencies.

Furthermore, the skilled artisan will recognize the interchangeability of various features from different embodiments. For instance, the monitoring unit's transceiver may only be a transmitter configured to transmit data at preset intervals or alarms to the relay unit; and the relay unit's transceiver may only be a receiver configured to receive transmissions from the monitoring unit. In addition to the variations described herein, other known equivalents for each feature can be mixed and matched by one of ordinary skill in this art to construct systems to deliver customized context sensitive content to a user in accordance with principles of the present invention.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the breadth and scope of the present invention herein disclosed should not be limited by the particular disclosed embodiments described above, but should be determined only by a fair reading of the claims that follow.

I claim:

1. A system for monitoring a gas/oil well, comprising:

a monitoring unit at a well head, the monitoring unit including a wireless monitor transceiver consuming power at a safe level for avoiding an explosion risk and further including a gas tight box for housing sensor processing electronics, said wireless monitor transceiver located outside of said gas tight box;

a relay unit including a wireless relay transceiver communicating with the wireless monitor transceiver of the monitoring unit and further including a telephone communication link; and a host interface communicating with the relay unit through the telephone communication link.

2. The system of claim 1, wherein the monitoring unit senses a condition of the gas/oil well.

3. The system of claim 2, wherein the monitoring unit senses pressure level.

4. The system of claim 2, wherein the monitoring unit senses temperature.

5. The system of claim 2, wherein the monitoring unit senses the presence or absence of flame.

6. The system of claim 1, wherein the wireless transmitter radiates less than about 0.75 mW of power.

7. The system of claim 1, wherein the telephone communication link comprises a cellular connection.

8. A method of communicating to and from an explosive environment, comprising:

situating a first transceiver in said explosive environment, said transceiver operating at a power level which is below the level defined as dangerous within said explosive environment;

situating a second transceiver proximate to but outside of said explosive environment, said second transceiver operating at a power level which is above the level defined as dnagerous within said explosive environment; and communicating with said first transceiver through said second transceiver from a location outside of said explosive environment and not proximate to said explosive environment.

9. Apparatus for communicating to and from an explosive environment, comprising:

a first transceiver in said explosive environment, said transceiver operating at a power level which is below the level defined as dangerous within said explosive environment;

a second transceiver proximate to but outside of said explosive environment, said second transceiver operating at a power level which is above the level defined as dangerous within said explosive environment; and a third transceiver outside of said explosive environment and not proximate to said explosive environment which is configured to communicate with said first transceiver through said second transceiver.

10. A method of communicating to and from an explosive environment, comprising:

situating a first transceiver in said explosive environment, said first transceiver having a first range and operating at a first power level;

situating a second transceiver outside said explosive environment but within said first range, said second transceiver having a longer, second range and operating at a higher, second power level;

situating a third transceiver outside said explosive environment, outside said first range, but within said second, longer range; and communicating between said first and third transceivers through said second transceiver.

11. Apparatus for communicating to and from an explosive environment, comprising:

a first transceiver positioned in said explosive environment, said first transceiver having a first range and operating at a first power level;

a second transceiver positioned outside said explosive environment but within said first range, said second transceiver having a longer, second range and operating at a higher, second power level; and a third transceiver positioned outside said explosive environment, outside said first range, but within said second, longer range, said third transceiver configured to communicate with said first transceiver through said second transceiver.

* * * * *